US011678754B2

(12) United States Patent
Gonullu et al.

(10) Patent No.: US 11,678,754 B2
(45) Date of Patent: Jun. 20, 2023

(54) CUP FOR TREMOR PATIENTS

(71) Applicant: Istanbul Medipol Universitesi, Istanbul (TR)

(72) Inventors: Helbest Jiyan Gonullu, Istanbul (TR); Kadir Tan, Istanbul (TR); Devrim Tarakçi, Istanbul (TR); Kübra Sahadet Sezer, Istanbul (TR)

( * ) Notice: Subject to any disclaimer, the term of this patent is extended or adjusted under 35 U.S.C. 154(b) by 0 days.

(21) Appl. No.: 17/771,751

(22) PCT Filed: Nov. 12, 2020

(86) PCT No.: PCT/TR2020/051093
§ 371 (c)(1),
(2) Date: Apr. 25, 2022

(87) PCT Pub. No.: WO2021/101486
PCT Pub. Date: May 27, 2021

(65) Prior Publication Data

US 2022/0369836 A1 Nov. 24, 2022

(30) Foreign Application Priority Data

Nov. 19, 2019 (TR) ..... 2019/18043

(51) Int. Cl.
*A47G 19/22* (2006.01)

(52) U.S. Cl.
CPC .... *A47G 19/2261* (2013.01); *A47G 2200/046* (2013.01)

(58) Field of Classification Search
CPC ..... A47G 19/22; A47G 2200/046; A47G 2200/166; A47G 21/08; A47G 2400/086; A47J 41/0094; A47J 43/28; A61B 5/1101; B65D 23/10; B65D 23/104
USPC ..... 248/11.2; 224/148.7, 641; 220/710.5, 220/703
See application file for complete search history.

(56) References Cited

U.S. PATENT DOCUMENTS

2003/0006357 A1* 1/2003 Kaiser ..... A61H 23/02 248/550
2016/0130035 A1* 5/2016 Civelli ..... A47G 19/2205 220/501
2020/0029710 A1* 1/2020 Jensen ..... A47G 19/2266

FOREIGN PATENT DOCUMENTS

CN 201370373 Y 12/2009
CN 201938957 U 8/2011
CN 105686557 A 6/2016
(Continued)

OTHER PUBLICATIONS

International Search Report for corresponding PCT/TR2020/051093, dated Mar. 4, 2021.
(Continued)

*Primary Examiner* — King M Chu
(74) *Attorney, Agent, or Firm* — Egbert, McDaniel & Swartz, PLLC; Kevin McDaniel

(57) ABSTRACT

A cup developed for tremor patients, which provides for the tremor patients to carry out their dietary activities in an easy way, suitable for long-term usage, the cup including a body, an upper body, a central body, a lower body, a valve, a button, a plane, a wire, an under-button spring, a cup handle spring, a spring at the back of the pin, a spring at the back of magnet-c, a body sheath, pockets, a handle sheath, a magnet housing, a magnet-a, a magnet-b and a magnet-c.

6 Claims, 4 Drawing Sheets

(56) References Cited

FOREIGN PATENT DOCUMENTS

Figure 1:
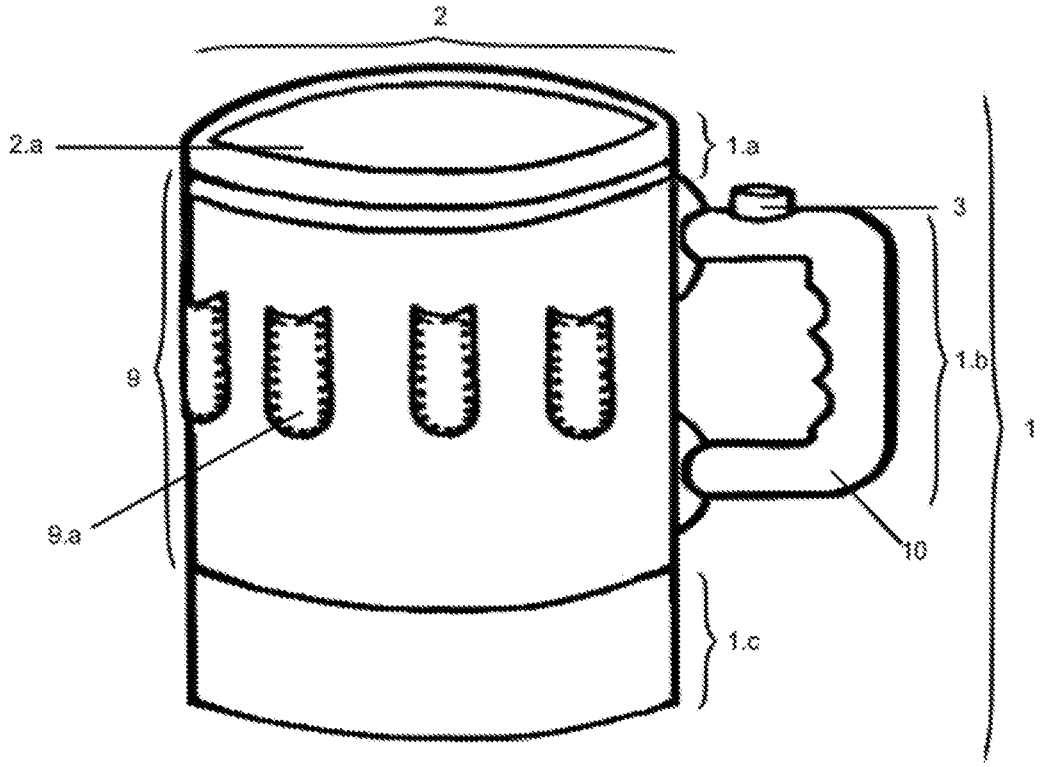

| | | | |
|---|---|---|---|
| CN | 108201477 | A | 6/2018 |
| WO | 2016102958 | A1 | 6/2016 |

OTHER PUBLICATIONS

Written Opinion of the International Searching Authority for corresponding PCT/TR2020/051093, dated Mar. 4, 2021.

* cited by examiner

CUP FOR TREMOR PATIENTS

TECHNICAL FIELD

The invention is related to a cup, which has been developed for tremor patients and which provides for the disabled, elderly and chronic patients to carry out their daily dietary activities in a secure and easy way.

PRIOR ART

Trembling (tremor) is a movement disorder that manifests with the short-term spasms of the muscles. Tremor means trembling and is the symptom of many different diseases. Essential tremor, which is one of the types of tremors is a neurological disease which primarily causes rhythmical trembling that is seen single-sidedly on the hands, legs, voice, body or hips.

The patients with essential tremor experience uncontrollable trembling with their hands, head, voice or body parts. This condition generally starts in adulthood and advances with age. The trembling typically shows when the hands are reached out or during small hand movements, for example, when holding a cup or spoon, or writing.

Essential tremor is frequently seen with women and men over the age of 60. Due to tremors, the individuals experience difficulties in their Activities of Daily Living (ADL) due to the problems with their motor skills. Dietary activities are at the top of these difficulties. Individuals have a hard time carrying out their dietary activities independently or become completely unable to do so. Individuals experience problems when they have a drink especially, due to the hand tremors and spill the liquid contents in the cup. Serious injuries can occur on their persons due to hot liquid content of the cup, or the cup breaking and shattering to pieces.

In the prior art, pharmacological treatment methods are generally used in the treatment of tremors. There are two pharmacological treatments frequently used as beta-adrenergic blockers and primidone. In the beta blocker treatment, there are frequently seen side affects of bradycardia, fatigue, nausea, diarrhea, rash, impotence and depression. Beta blockers are not recommended for patients with congestive heart failure, asthma, third-degree antriventricular block, and diabetes. Other pharmacological treatments work temporarily.

In the prior art, the essential tremor patients are loaded with weights on their trembling side to rehabilitate and provide function in their daily lives, or they are inhibited by stabilization (support) from the proximal. However, while these methods reduce trembling, they cause destruction on the muscles by overloading them. The mobility of the patients is observed to be decreasing during the stabilization.

BRIEF DESCRIPTION OF THE INVENTION

The purpose of the invention is to provide individuals independency with compensatory intervention option, which is one of the occupational therapy intervention methods. In order for the individuals with essential tremors to carry out their dietary activities as one of their activities of daily living in a safer and better way, the individual's hand tremor preventing the independent liquid intake and spilling of the liquid on the individual is avoided.

Another purpose of the invention is to reduce the force needed to be applied while the individuals experiencing loss of muscle force lift the cup by means of the spring mechanism at the handle of the cup and to remedy the sensory loss of the individual by means of "providing sensory input condition", which is one of the therapeutical rehabilitation methods. By minimizing the hand tremor the individual experiences, it is provided that the cup is brought to the mouth with more ease as the hand and arm drifting is reduced by the gripping of the cup more easily.

The hand tremors experienced by individuals causes spilling of liquid on the individuals and pose an obstacle for the individuals' liquid intake. With the invention, these problems are prevented. With the cup structure of the invention, thanks to different textures stimulating the individual's sensory system (tactile sensation in particular), a sensory awareness is provided for the individual.

The structural and characteristic features of the invention with all the advantages will be understood more clearly from below figures and the detailed descriptions written. Therefore, the evaluation should be made in consideration of these figures and detailed explanations.

FIGURES AIDING THE DESCRIPTION OF THE INVENTION

FIG. 1: Side view of the cup for tremor patients.

Figure 2:
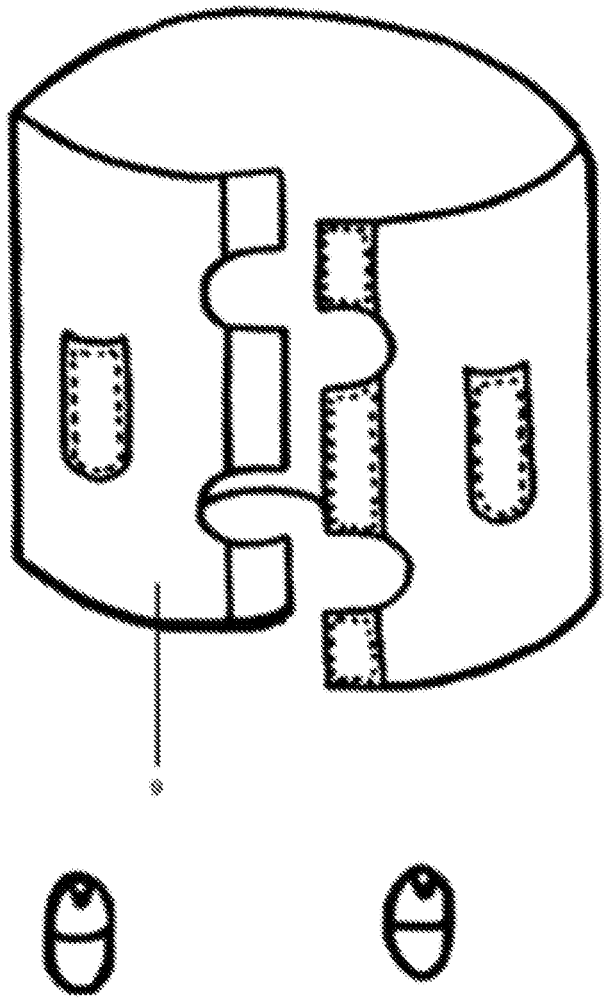

FIG. 2: Perspective view of the cup sheath of the cup for tremor patients.

Figure 3:
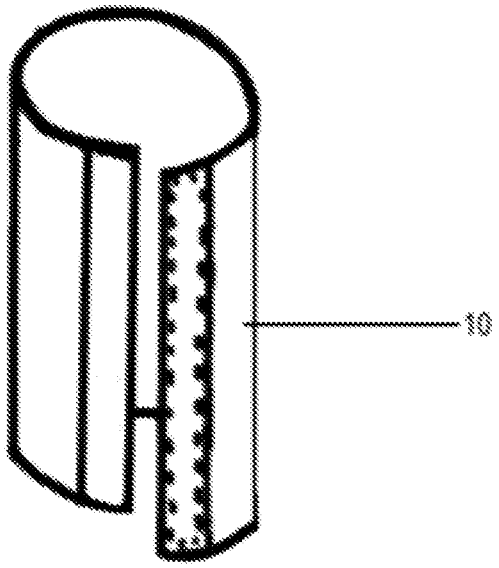
Figure 4:
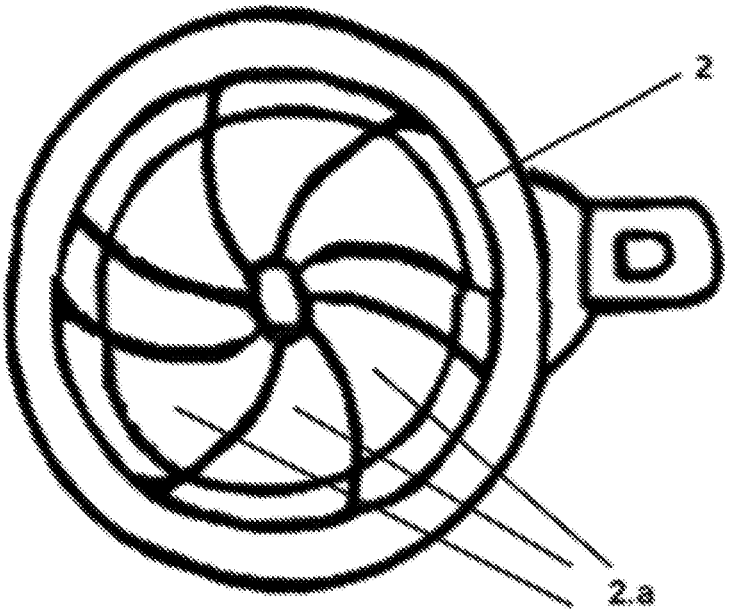

FIG. 3: Perspective view of the handle sheath of the cup for tremor patients FIG. 4: Top view of the valves of the cup for tremor patients.

Figure 5:
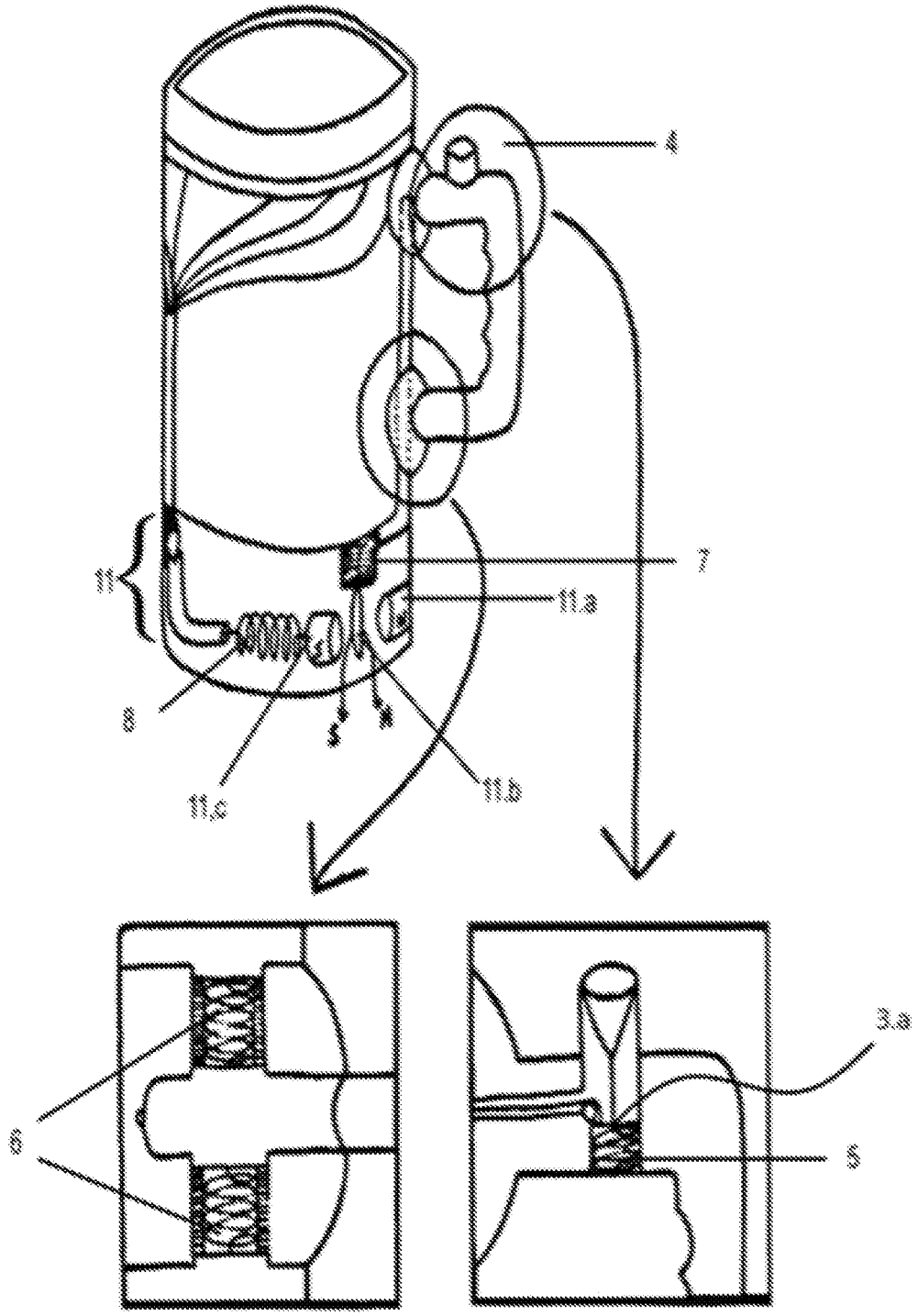

FIG. 5: Detailed view of the parts of the cup for tremor patients.

REFERENCE NUMBERS AIDING THE DESCRIPTION OF THE INVENTION

1. Body
- 1.*a* Upper body
- 1.*b* Central body
- 1.*c* Lower body

2. Cover
- 2.*a* Valves

3. Button
- 3.*a* Plane

4. Wire
5. Under-button spring
6. Cup handle spring
7. Spring at the back of the pin
8. Spring at the back of magnet-c
9. Body sheath
- 9.*a* Pockets

10. Handle sheath
11. Magnet housing
- 11.*a* Magnet-a
- 11.*b* Magnet-b
- 11.*c* Magnet-c

DETAILED DESCRIPTION OF THE INVENTION

The invention comprises of a body (1); an upper body (1.*a*), a central body (1.*b*) and a lower body (1.*c*). There is a cover (2) on the top of the cup. This cover (2) is composed of a main valve (2.*a*) and secondary valves (2.*a*). The sides of the valves (2.*a*) facing each other are coated with a sealing material. Valves (2.*a*) close rapidly at the moment of the patient dropping the cup and prevent its liquid contents from spilling. When applied force, these valves (2.*a*) can fold inwards and return to their former state when the application of the force is stopped. There are wires (4) within the valves (2.*a*). These wires (4) combine in the pathway under the main valve and become a single wire (4). The wire (4) which becomes a single-piece connects to the magnet-c (11.*c*) under the cup. With the pin being pulled from between, magnet-c (11.*c*) provides for the opening and closing of the valves (2.*a*).

There Is a button (3) providing the operation of the mechanism at the handle of the cup. Under the button (3), there is a plane (3.*a*) where the wire (4), which is connected to the pin at the lower part of the cup and the rod, which is the continuation of the button (1) are combined. When the button (3) is pressed, this plane (3.*a*) descends and the pin is pulled from between the magnets and the valves (2.*a*) at the mouth of the cup open.

At the spot where the handle of the cup connects with the cup itself, there is a cup handle spring (6). The silicones holding the handle part with this cup handle spring (6) provide a flexibility to the cup and it is provided that the cup resists against the tremor. These springs are placed at the top and bottom of the 2 points wherein the cup handle is connected to the body (1). They are 4 in total. The cup handle spring (6) on the handle part is inside a foldable chamber. Under the plane (3.*a*) where the wire (4), which is connected to the pin at the lower part of the cup and the rod, which is the continuation of the button (1) are combined, there is an under-button spring (5).

With this spring it is aimed that the button (3) remains inside when the force applied on the button (3) is removed. There are pockets (9.*a*) on the outside of the body sheath (9). Thanks to this body sheath (6), the cup can be used both during rehabilitation and the daily life. Extra weights can be attached to the pockets (9.*a*) on the body sheath (9), which contribute to reducing the tremor. Depending on the intensity of the tremors on the hand of the individual, the weights can be attached or removed, therefore, maximum stability is provided as the cup is hold. In addition, this body sheath (9) provides tactile sensation input (touching) for the individual. Additionally, there is a handle sheath (10) which can be put on the handle and which provides tactile sensation input (touching) for the individual.

There is a magnet housing (11) in which 3 magnets take place at the bottom of the said invention. Magnet-a (11.*a*) is fixed at the bottom of the cup handle. Magnet-c (11.*c*) is a movable magnet and provides for the opening and closing of the cup under the effect of other magnets by combining with the wires (4) inside the valves (2.*a*) that cover the cup by means of a pipe. There is a spring at the back of magnet-c (8) for controlling the speed at which the cover opens and closes, behind the magnet-c. Magnet-b (11.*b*) is the pin entering in between these two magnets and the pin is connected to the button (3) at the upper part of the handle. Thanks to this magnetic pin being a magnet placed in the opposite pole according to other magnets, other valves (2.*a*) are prevented from staying open continuously when the button (3) is not pressed and the other magnets from attracting each other. There is a tense spring at the back of the pin (7) behind the pin that is connected to the button (3) and enters between the two magnets and this spring prevents the pin from backing away. Therefore, the pin stays up and the cover (2) part always stays open.

The cup operates mechanically with springs, wires (4) and magnet assemblies. Therefore, the product does not require charging and remains ready-to-use at any moment for a long time. The inner part of the cup is coated with Lotus Flower. As per the structure of the Lotus Flower, developing stainless, self-cleaning and anti-bacterial properties will be provided for the cup. These features make it easier for the individual to clean the cup.

A reference number follows the technique and all other features in each claim and these reference numbers are used solely with the purpose of making it easier to understand the claims. Therefore, none of the elements indicated by these reference numbers given with the purpose of illustration should be considered as limiting the scope of the invention.

It is clear that a person skilled in the art can provide the innovation put forth by the invention by using similar embodiments and/or apply this embodiment to other fields with similar purposes used in the related prior art. Therefore, it will be evident that such embodiments will also lack the criterion of innovation and going beyond the known state of the art.

The invention claimed is:

1. A cup for tremor patients which provides for the easy movement of the patients and sensory input, the cup comprising:

- a body composed of an upper body, a central body and a lower body;
- a cover composed of one main valve and secondary valves;
- valves that are located at the mouth of the cup and coated with sealing material on the sides facing each other, preventing the liquid content from being spilled by rapidly closing at the moment of the patient dropping the cup;
- a button that provides for the operation of the mechanism inside the handle part of the cup;
- wires which become one by combining in the pathway under the main valve, placed inside the valves;
- an under-button spring that is located under the button providing for the operation of the mechanism and prevents the button from staying inside when the force is removed;
- a cup handle spring that is located wherein the handle is connected to the cup, located inside a foldable chamber and on both the top and bottom sides of the handle part;
- a spring at the back of the pin which is located at the back of the magnetic pin and prevents the pin from going up;
- a spring at the back of magnet-c which is located at the back of magnet-c and adjusts the speed of the valves opening and closing;
- a body sheath which can be attached on the outside and that can be used both during rehabilitation and daily life;
- pockets which are located the outside of the body sheath and on which weights that contribute to reducing tremors can be attached;
- a handle sheath which can be attached on the outside of the handle and which provide tactile sensation input for the individual;
- a magnet housing which has 3 magnets at the lower part;
- magnet-a, which is fixedly located on the bottom side of the cup handle;
- a movable magnet-b, which enters between the two magnets and which is connected to the button, placed in the opposite pole; and
- magnet-c, wherein the wires inside the valves at the mouth of the cup combine by moving through a small pathway at the front side of the cup, which provides for the opening of the cover with the pin being pulled from between.

2. A cup for tremor patients according to claim 1, wherein it comprises a magnet-b which is placed having opposite forces according to other magnets and therefore provides for the valves to remain open continuously.

3. A cup for tremor patients according to claim 1, comprising a plane where the button, the rod which is the continuation of the button under the same, and the wire which is connected to the pin coming from the lower part of the cup combine.

4. A cup for tremor patients according to claim 1, wherein it comprises a button, which provides for the valves at the mouth of the cup to open with the pin being pulled from between the magnets with the plane's when it is pressed.

5. A cup for tremor patients according to claim 1, wherein it comprises valves which can fold inwards when applied force and which can return to their former state when the application of the force is stopped.

6. A cup for tremor patients according to claim 1, wherein the inside of the cup is coated with lotus flower.

* * * * *